US007634209B2

(12) United States Patent
Tanaka

(10) Patent No.: US 7,634,209 B2
(45) Date of Patent: Dec. 15, 2009

(54) TEMPERATURE CONTROL METHOD FOR FIXING DEVICE, AND FIXING DEVICE AND IMAGE-FORMING APPARATUS THAT USE THE SAME

(75) Inventor: Hiroshi Tanaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 544 days.

(21) Appl. No.: 11/672,015

(22) Filed: Feb. 6, 2007

(65) Prior Publication Data

US 2007/0188536 A1 Aug. 16, 2007

(30) Foreign Application Priority Data

Feb. 10, 2006 (JP) ..... 2006-034348

(51) Int. Cl.
*G03G 15/20* (2006.01)
*B41J 29/28* (2006.01)

(52) U.S. Cl. ..... 399/69; 347/17

(58) Field of Classification Search ..... 399/69; 347/17

See application file for complete search history.

(56) References Cited

U.S. PATENT DOCUMENTS

2002/0061202 A1* 5/2002 Kataoka ..... 399/69
2007/0134018 A1* 6/2007 Nanba et al. ..... 399/69

FOREIGN PATENT DOCUMENTS

JP 3695525 7/2005

* cited by examiner

*Primary Examiner*—David M Gray
*Assistant Examiner*—Joseph S Wong
(74) *Attorney, Agent, or Firm*—Hogan & Hartson LLP

(57) ABSTRACT

A temperature control method for a fixing device, which includes a heating unit that heats a recording material; a temperature detecting unit that detects a temperature of the heating unit; and a temperature controlling unit that determines an amount of power supplied based on a detected temperature of the temperature detecting unit, and controls the temperature of the heating unit by supplying the determined amount of power supplied, wherein temperature is sampled by the temperature detecting unit at a prescribed cycle, and the amount of power supplied is determined on the basis of this detection result, and when the duty cycle of the determined amount of power supplied is no more than 50%, a first period during which power is intermittently supplied to the heating unit, and a second period during which a power supply to the heating unit is not permitted are set within the prescribed cycle.

3 Claims, 4 Drawing Sheets

TEMPERATURE CONTROL METHOD FOR FIXING DEVICE, AND FIXING DEVICE AND IMAGE-FORMING APPARATUS THAT USE THE SAME

CROSS-REFERENCES TO RELATED APPLICATIONS

The entire disclosure of Japanese Patent Application No. 2006-34348, filed on Feb. 10, 2006, is expressly incorporated by reference herein.

BACKGROUND

1. Technical Field

The present invention relates to an image-forming apparatus of an electrophotography system utilized in a copier, printer, facsimile machine and other such apparatus, and more particularly to a fixing device that uses heat, and a temperature control method therefor.

2. Related Art

A thermal fixing device, which heats a heater by supplying power, and uses this heat to carry out fixing as a method for fixing an electrophotographic image to a recording material, has been utilized widely for some time. In this thermal fixing device, a fixing-enabled state is achieved by supplying power to a heater, and raising the temperature until a required temperature is reached, then a recording material is conveyed to and made to pass through the fixing device while this fixing-enabled state is maintained. For this reason, as control when heating the heater, for example, the temperature of the heater is detected using a thermistor or other such temperature detecting unit, and according to the difference between this detected temperature and a preset temperature, there is 1) a phase control method, which controls the supply of power by changing the angle of energization in the alternating current half-cycle; 2) an ON/OFF control method, which turns ON the power to the heater if the detected temperature is lower than a prescribed target temperature, and turns OFF the power if the detected temperature is higher than the prescribed target temperature; and 3) a pulse-width control method, which controls the alternating current output by synchronizing the power to the heater to the zero-cross of the alternating current and changing the pulse width.

Of these methods, the ON/OFF control method generates temperature ripples due to overshoot subsequent to turning ON power, and undershoot subsequent to turning OFF power, making it difficult to achieve a stable state favorable to fixing. Using a heater having relatively high thermal capacity to reduce this overshoot and undershoot increases warm-up time, that is, the time it takes to raise the temperature of the heater to a temperature that is capable of producing a favorable fixing state. In order to achieve a device constitution that shortens warm-up time, and enables the rapid realization of a favorable fixing state, it is necessary to use a fixing device comprising a heater with low thermal capacity, or a fixing device comprising a heater with high electrical energy. However, temperature ripple is apt to occur, and reducing temperature ripple to shorten warm-up time is problematic.

Furthermore, ON/OFF control and pulse-width control that utilize a fixing device comprising a heater with low thermal capacity and high electrical energy for reducing warm-up time have the following shortcomings in addition to those described hereinabove. That is, when the heater is turned from ON to OFF, or conversely, turned from OFF to ON, flicker resulting from fluctuations in the power supply voltage occurs in the other electrical equipment, especially illumination equipment, which is connected to the same power supply line as either the fixing device or an image-forming apparatus comprising this fixing device.

By contrast, Japanese Patent No. 3,695,525, referred to herein as Patent Literature 1, discloses temperature control method for a fixing device, in which, as shown in FIG. 7, the temperature of the heater is controlled by supplying power in accordance with a first period $\Delta t_3$ during which the power supply to the heater is permitted, and a second period $\Delta t_4$ during which the power supply to the heater is not permitted, and in the first period, the power is supplied in a power-supply pattern comprising at least one unit of energization and at least one unit of non-energization. This temperature control method makes possible fine-tuned, high-precision temperature control that reduces power supply voltage fluctuations (ripples) in a fixing device, which comprises either a low thermal capacity or high electrical energy heating unit, or an image-forming apparatus comprising this fixing device, and, in addition, makes it possible to suppress eye-annoying flicker in other electrical equipment on the same power supply line, especially illumination equipment (a fluorescent lamp, incandescent lamp, etc.) and a display.

SUMMARY

In the temperature control method disclosed in Patent Literature 1, temperature sampling is carried out at a prescribed cycle, an amount of power supplied is determined based thereon, and the time allocation of the first period and second period, as well as the power-supply pattern of the first period are set on the basis of the percentage of energization time (hereinafter referred to as the "duty cycle") determined based on the amount of power supplied thus determined.

Now then, although the time allocation and the power-supply pattern for when the duty cycle is no more than 20% are disclosed in Patent Literature 1, the time allocation and the power-supply pattern for when the duty cycle is high are not particularly disclosed.

Examining this point, energization time is at the maximum in the invention disclosed in Patent Literature 1 when the second period, during which power is not supplied, does not exist, and the power-supply pattern of the first period comprises one unit of energization and one unit of non-energization, that is, when the duty cycle is 50%. Therefore, the invention disclosed in Patent Literature 1 does not clarify how temperature control should be carried out when the duty cycle exceeds 50%.

With the foregoing in view, an advantage of some aspects of the invention is the realization in either a fixing device comprising a heating unit (a heater) with either a relatively low thermal capacity or relatively high electrical energy, or an image-forming apparatus comprising this fixing device, of a fixing device temperature control method, which is capable of appropriately supplying power to the heating unit and fine tuning temperature control, even when the duty cycle of the power supply exceeds 50%.

To solve for the above-mentioned problems, a fixing device temperature control method of the invention is a temperature control method of a fixing device comprising a heating unit that heats a recording material; a temperature detecting unit that detects a temperature of the heating unit; and a temperature controlling unit that determines an amount of power supplied based on a detected temperature of the temperature detecting unit, and controls the temperature of the heating unit by supplying the determined amount of power supplied, wherein temperature is sampled by the temperature detecting unit at a prescribed cycle, and the amount of power supplied is determined on the basis of this detection result, and when the duty cycle of the determined amount of power supplied is no more than 50%, a first period during which power is intermittently supplied to the heating unit, and a second period during which a power supply to the heating unit is not permitted are set within the prescribed cycle, such that a total amount of power supplied in the first period and second period becomes the amount of power supplied, power being supplied to the heating unit during the first period in a power-supply pattern comprising one unit of energization and one unit of non-energization, and power not being supplied to the heating unit during the subsequent second period, and when the duty cycle of the determined amount of power supplied exceeds 50%, a first period during which power is intermittently supplied to the heating unit, and a third period during which power is continuously supplied to the heating unit are set within the prescribed cycle, such that a total amount of power supplied in the first period and third period becomes the amount of power supplied, power being supplied to the heating unit during the first period in a power-supply pattern comprising one unit of energization and one unit of non-energization, and power being supplied continuously to the heating unit during the subsequent third period.

According to the invention, it is possible to provide, either in a fixing device comprising a heating unit (a heater) having either a relatively low thermal capacity or relatively high electrical energy, or in an image-forming apparatus comprising this fixing device, a fixing device temperature control method, which is capable of appropriately supplying power to the heating unit and of fine-tuning temperature control, even when the duty cycle of the power supply exceeds 50%. Accordingly, it is possible to lessen the load of heating unit temperature control on the CPU (Central Processing Unit) of an image-forming apparatus, and to make use of a PID or other such advanced temperature control unit, enabling reduced power supply voltage fluctuations (ripple) and fined-tuned, high-precision temperature control. Also, supplying power in an intermittent power-supply pattern makes it possible to suppress eye-annoying flicker in other electrical equipment on the same power line as the fixing device or an image-forming apparatus comprising this fixing device, especially illumination equipment (a fluorescent lamp, incandescent lamp, etc.) and a display.

Further, the invention comprises a fixing device, which utilizes such a fixing device temperature control method, and an image-forming apparatus comprising this fixing device. According to this invention, it is possible to realize either a fixing device comprising outstanding temperature control performance, or an image-forming apparatus comprising this fixing device. Furthermore, since it is possible to curb the rush current to the fixing device heating unit (heater), a more durable fixing device or image-forming apparatus comprising this fixing device can be realized.

DESCRIPTION OF EXEMPLARY EMBODIMENTS

An embodiment that applies a fixing device temperature control method of the invention to a printer, which is one kind of image-forming apparatus, will be explained below in accordance with the figures. First, an overview of the fixing device and the overall control device thereof will be explained.

Figure 1:
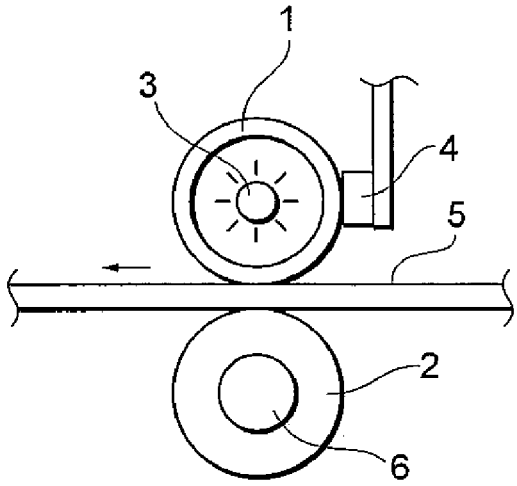
FIG. 1 is a cross-sectional view showing the constitution of a fixing device related to this embodiment.

FIG. 1 is a cross-sectional view showing the constitution of a fixing device related to this embodiment. A halogen lamp heater 3 is provided inside a rotatably supported heating roller (fuser roller) 1, and the heating roller 1 is heated by applying a prescribed power. A thermistor-equipped temperature sensor 4 is pressed against the surface of the heating roller 1, and energizing power to the halogen lamp heater 3 is controlled in accordance with the detected temperature of the temperature sensor 4. An elastic layer of silicon rubber is provided on the peripheral surface of a metal shaft 6 of a rotatably supported pressure roller 2, and this pressure roller 2 makes pressure-contact with the heating roller 1 by applying a load, which is not shown in the figure, to both ends of the shaft, forming the nip part. Fixing is carried out by passing a recording material 5, on which a non-fixed toner image is formed, through this nip part.

There are no particular limitations on the recording material that can be used in either the fixing device or an image-forming apparatus comprising this fixing device of the invention, and a piece of paper a postcard, an envelope, a film, a thin plate, or other such sheet-shaped material can be utilized as desired.

Figure 2:
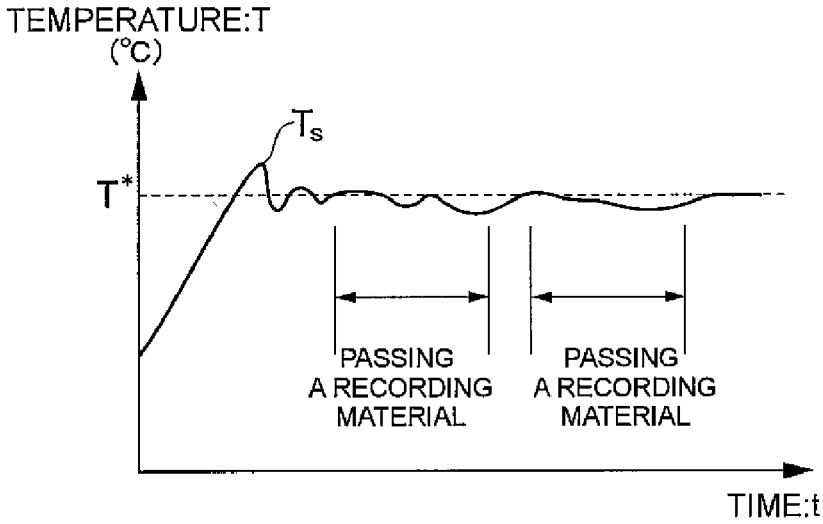
FIG. 2 is a diagram showing temperature fluctuations on a heating roller 1 related to this embodiment.

FIG. 2 is a diagram showing temperature fluctuations in a heating roller 1 related to this embodiment. The vertical axis indicates the temperature T of the heating roller 1, and the horizontal axis shows the elapsed time t. Temperature fluctuations of the heating roller 1 over time are indicated by Ts. First, heating of the heating roller 1 commences together with the inputting of image information sent from an external printer. Then, immediately after the temperature Ts of the heating roller 1 reaches the target temperature T*, the power to the halogen lamp heater 3 is shut OFF. However, the temperature $T_S$ of the heating roller 1 is in the overshoot state, and the temperature rises for a brief period. Thereafter, the temperature $T_S$ of the heating roller 1 drops to the vicinity of the target temperature T*, power begins to be applied each prescribed temperature detection sampling time, the temperature of the heating roller 1 stabilizes, and subsequent to stabilizing within a prescribed temperature range, the recording material 5 begins to pass through the fixing device.

Figure 3:
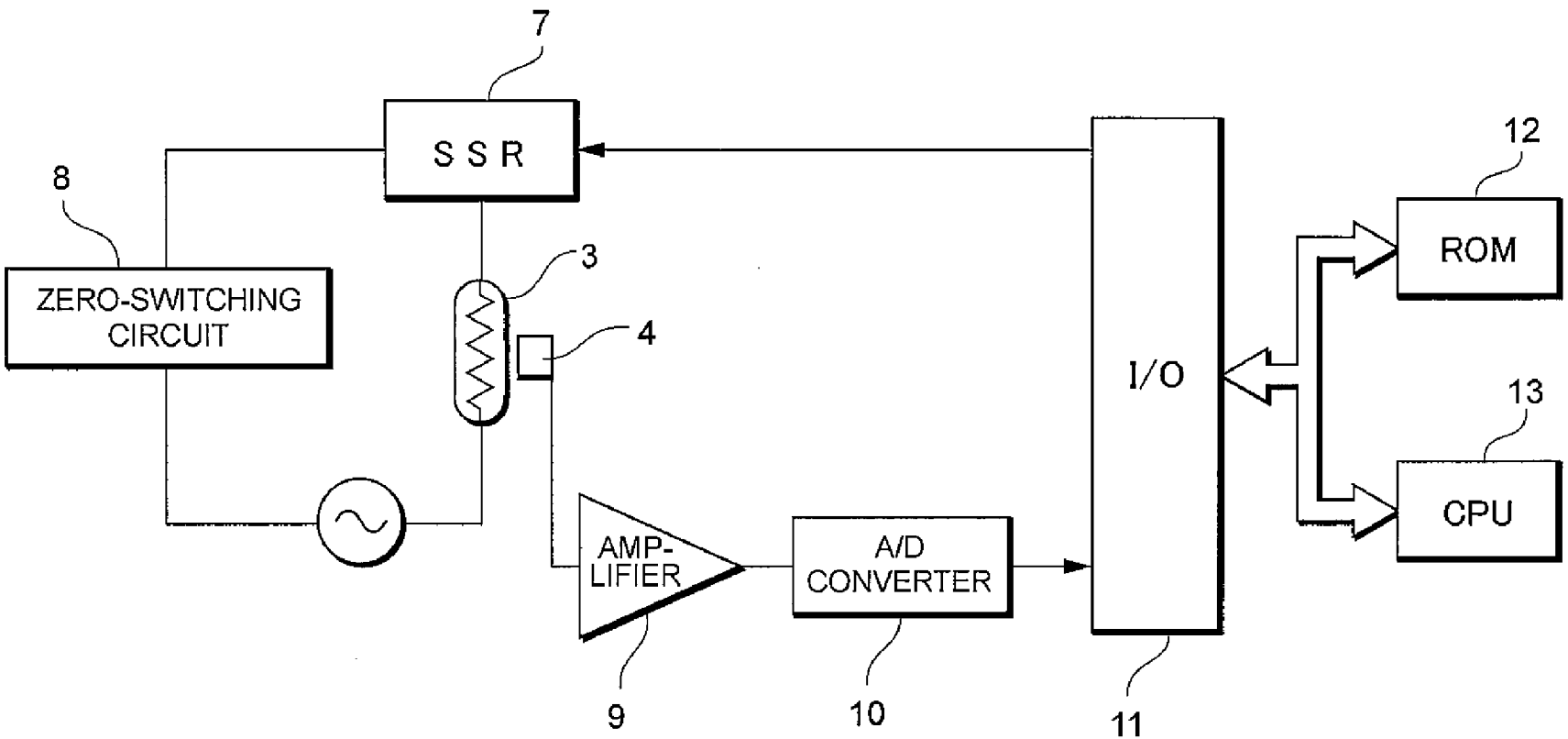
FIG. 3 is a block diagram showing the constitution of a control device for controlling the temperature of the heating roller 1.

FIG. 3 is a block diagram showing the constitution of a control device for controlling the temperature of the heating roller 1. An analog voltage signal outputted from the temperature sensor 4 is inputted to an A/D converter 10 by way of an amplifier 9. A signal, which has been converted to a 256-level digital signal by the A/D converter 10, is inputted to an I/O unit 11. Then, at each prescribed sampling time, that is, at every second cycle of the present invention, this digital signal is inputted to a CPU 13, which executes a temperature control program. This second cycle will be explained hereinbelow. The temperature control program resides in a ROM 12, and is fetched and executed by the CPU 13 as needed. The CPU 13, by executing the temperature control program, determines the amount of power supplied to the halogen lamp heater 3 in accordance with the following mathematical expression (1) based on a detected temperature. Then, the CPU 13 intermittently energizes the halogen lamp heater 3 in accordance with a method, which will be explained hereinbelow.

A control signal generated by the CPU 13 is sent to an SSR (Solid State Relay) 7, which is a switch that causes the halogen lamp heater 3 to flicker. A signal, which has been synchronized to the alternating current zero-cross, is also sent to the SSR 7 from a zero switching circuit 8. The SSR 7, upon receiving a signal from the zero-switching circuit 8, turns ON if there is a control signal from the CPU 13, and turns OFF if there is no control signal. Accordingly, the SSR 7 is turned ON and OFF by a control signal from the CPU 13 by treating half of the cycle of an alternating current wave as one unit, and heater energization is carried out in accordance with this. In order to carry out ON/OFF using a half-cycle unit of an AC wave form, the constitution can be such that a signal from the zero switching circuit 8 applies an interrupt to the CPU 13, and a control signal from the CPU 13 is outputted on the basis of this interrupt signal.

The temperature control program in this embodiment determines the amount of power supplied in accordance with the equation:

$$P=G\cdot(T^*-T_C)+P_C \tag{1}$$

wherein P is the power supplied to the halogen lamp heater 3; T* is the target temperature, G is gain, and $P_C$ is the offset power. Here, $T_C$ is the corrected value of a detected temperature, and is found using the temperature sensor 4 detection delay equation:

$$T_C=T_S+k\tau\cdot\Delta T_S/\Delta t \tag{2}$$

wherein $T_S$ is the detected temperature of the temperature sensor 4, k is the correction factor, τ is the time constant of the temperature sensor 4, Δt is the prescribed sampling time of a detected temperature $T_S$, $\Delta T_S$ is the amount of variation of $T_S$ generated between Δt, and $\Delta T_S/\Delta t$ is the rate of change of the detected temperature of the temperature detecting unit. Thus, in the invention, since a temperature control program is executed at each prescribed sampling time, which is the second cycle, it is possible to incorporate an advanced temperature control method called predictive control, which is temperature control that predicts the time delay of the temperature sensor 4 and corrects for this.

In the computations of the above-mentioned equations (1) and (2), the detected temperature $T_S$ and so forth of the temperature sensor 4, as explained hereinabove, is an A/D-converted digital value, and the supply power P is determined by performing integer arithmetic inside the CPU 13.

Next, a method for supplying power to the halogen lamp heater 3 on the basis of the determined power supply P will be explained.

Figure 4:
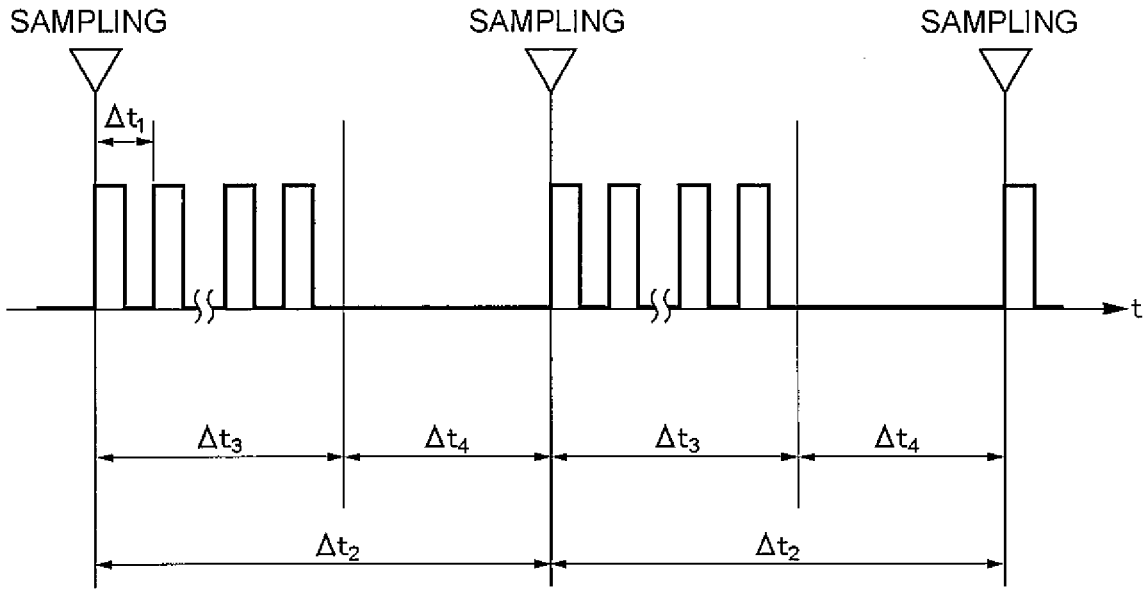
FIG. 4 is a diagram showing an example of a power supply method when the duty cycle is no more than 50%.
Figure 5:
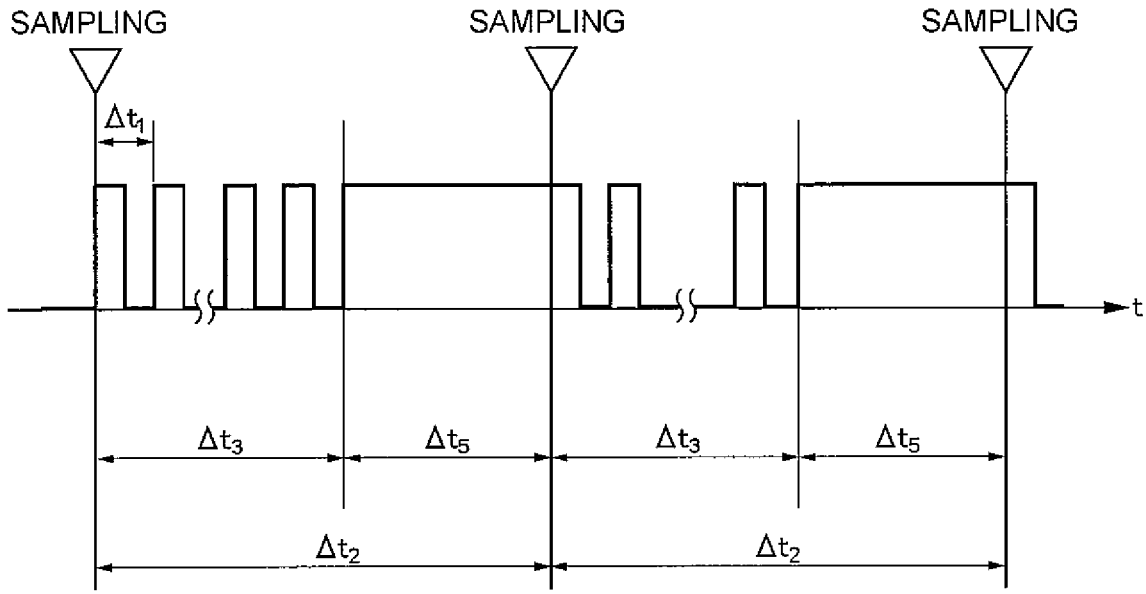
FIG. 5 is a diagram showing an example of a power supply method when the duty cycle exceeds 50%.
Figure 6:
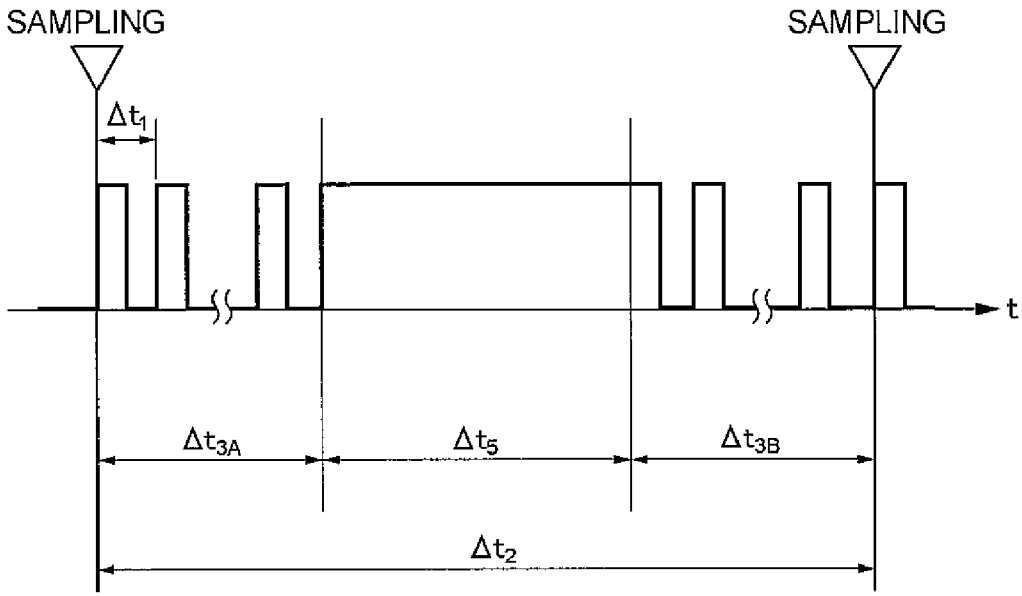
FIG. 6 is another embodiment of a power supply method when the duty cycle exceeds 50%.
Figure 7:
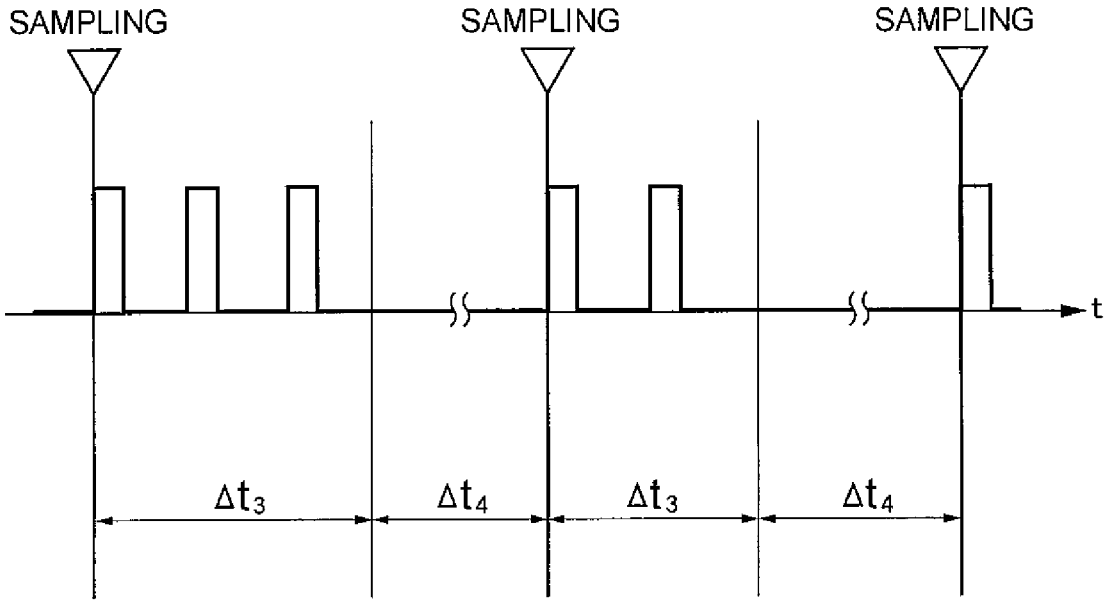
FIG. 7 is an established example of the invention.

FIGS. 4 through 6 are diagrams showing examples of power supply methods in a temperature control method related to this embodiment. The vertical axis indicates the ON/OFF of the power supply to the halogen lamp heater 3, and the horizontal axis indicates the time t. First, a detected temperature $T_S$ of the temperature sensor 4 making contact with the heating roller 1 is sampled each second cycle $\Delta t_2$, the CPU 13 determines the amount of power supplied based thereon as described hereinabove, and the percentage of energization time (duty cycle) in this second cycle $\Delta t_2$ is determined based on this amount of power supplied. That is, feedback control is performed using the second cycle $\Delta t_2$ as a single temperature control unit. Then, the power supply to the halogen lamp heater 3 is controlled in accordance with the duty cycle as described hereinbelow.

FIG. 4 is a diagram showing an example of a power supply method when the duty cycle is no more than 50%. When the duty cycle is no more than 50%, the second cycle $\Delta t_2$ is divided into a first period $\Delta t_3$ in which power is supplied intermittently to the halogen lamp heater 3, and a second period $\Delta t_4$ in which the power supply is not permitted. During the first period $\Delta t_3$, intermittent energization is carried out using the first cycle $\Delta t_1$, which is a shorter cycle than the second cycle $\Delta t_2$, as the unit. In this embodiment, a power-supply pattern, which comprises one unit of energization and one unit of non-energization, is formed in the first cycle $\Delta t_1$. The allocation of time between the first period $\Delta t_3$ and the second period $\Delta t_4$ is determined in accordance with the duty cycle, and is computed using equations (3) and (4).

$$\text{First period: } \Delta t_3=2\cdot Pd\cdot\Delta t_2 \tag{3}$$

$$\text{Second period: } \Delta t_4=(1-2\cdot Pd)\cdot\Delta t_2 \tag{4}$$

wherein Pd is the duty cycle.

FIG. 5 is a diagram showing an example of a power supply method when the duty cycle exceeds 50%. When the duty cycle exceeds 50%, the second cycle $\Delta t_2$ is divided into a first period $\Delta t_3$ in which power is supplied intermittently to the halogen lamp heater 3, and a third period $\Delta t_5$ in which the power is supplied continuously. During the first period $\Delta t_3$, intermittent energization is carried out using the first cycle $\Delta t_1$, which is a shorter cycle than the second cycle $\Delta t_2$, as the unit, the same as when the duty cycle is no more than 50%. A power-supply pattern, which comprises one unit of energization and one unit of non-energization, is formed in the first cycle $\Delta t_1$. The allocation of time between the first period $\Delta t_3$ and the third period $\Delta t_5$ is determined in accordance with the duty cycle, and is computed using the respective equations (5) and (6).

$$\text{First period: } \Delta t_3=2\cdot(1-Pd)\cdot\Delta t_2 \tag{5}$$

$$\text{Third period: } \Delta t_5=(2\cdot Pd-1)\cdot\Delta t_2 \tag{6}$$

FIG. 6 is a diagram showing another embodiment of a power supply method when the duty cycle exceeds 50%. As shown in FIG. 6, the second cycle $\Delta t_2$ is divided into a first period A $\Delta t_{3A}$ in which power is supplied intermittently to the halogen lamp heater 3, a third period $\Delta t_5$ in which the power is supplied continuously, and a first period B $\Delta t_{3B}$ in which power is supplied intermittently. In other words, the first period is divided into two parts, and how the first period is divided into two parts so that power is supplied in a form in which the third period is interposed therebetween can be arbitrarily set, but it is desirable that the two parts be equal. In this case, the allocations of time among the first period A $\Delta t_{3A}$, third period $\Delta t_5$, and first period B $\Delta t_{3B}$ are computed using the respective equations (7), (8) and (9).

$$\text{First period A: } \Delta t_{3A}=(1-Pd)\cdot\Delta t_2 \tag{7}$$

$$\text{Third period: } \Delta t_5=(2\cdot Pd-1)\cdot\Delta t_2 \tag{8}$$

$$\text{First period B: } \Delta t_{3B}=(1-Pd)\cdot\Delta t_2 \tag{9}$$

Furthermore, the power supply level can be subdivided the smaller the first cycle $\Delta t_1$ is compared to the second cycle $\Delta t_2$, but ordinarily it is desirable that a cycle be proportional to one cycle of the AC wave being supplied to the halogen lamp heater 3. This is because it is relatively easy to obtain a zero-cross signal that is synchronized to one cycle of the AC wave form.

Further, to control the temperature with high precision, it is desirable that the second cycle $\Delta t_2$ be set at no more than about three seconds, that is, at a frequency of greater than ⅓

Hz, that feedback control be performed, and that the duty cycle (amount of power supplied) be changed frequently. Conversely, if the second cycle $\Delta t_2$ is too short, the wave number of an AC half-wave inside a single second cycle $\Delta t_2$ is small, and it becomes impossible to subdivide the duty cycle level, thereby making it desirable to set the second cycle $\Delta t_2$ at no less than about 0.2 seconds, that is, no more than 5 Hz.

Carrying out energization control as described hereinabove makes it possible to properly supply power to the halogen lamp heater 3 even when the duty cycle exceeds 50%, and to carry out fixing device temperature control that enables fine-tuned temperature control. Further, it is possible to frequently change the amount of power supplied for each prescribed control cycle, that is, every second cycle $\Delta t_2$, making it possible to implement fine-tuned, stable temperature control in combination with advanced control such as PID control. In addition, temperature detection and duty cycle computations can be completed one time in the second cycle $\Delta t_2$, lessening the load on the CPU. Thus, an advantage is that it is possible to simultaneously control other parts inside an image-forming apparatus, and to make dual use of the CPU in the image-forming apparatus main unit without having to provide a dedicated CPU for temperature control.

Further, supplying power to the heating unit using a specific intermittent power-supply pattern makes it possible to suppress eye-annoying flicker in other electrical equipment on the same power line as the fixing device or an image-forming apparatus comprising this fixing device, especially illumination equipment (a fluorescent lamp, incandescent lamp, etc.) and a display.

Furthermore, the invention is not limited to the above-described aspects of the embodiment, and can be put into practice in a variety of other forms within a scope that does not depart from the gist of the invention. Thus, in every aspect, the above-described embodiment is simply an example, and is not to be interpreted limitatively.

For example, the temperature control method of the invention is not limited to a fixing device of a heated roller system having a halogen lamp as a heater as was explained in the above-described embodiment. Instead, for example, a resistor that is heated by energization, a xenon lamp and so forth can be preferentially utilized as the heater. Further, a variety of systems, such as a belt fixing device, a non-contact heating system, and the like can also be used as a fixing device.

Furthermore, besides a printer as in this embodiment, for example, a copier, facsimile machine, and the like can also be used as an image-forming apparatus capable of comprising a fixing device.

What is claimed is:

1. A temperature control method for a fixing device, comprising:

a heating unit that heats a recording material;

a temperature detecting unit that detects a temperature of the heating unit; and a temperature controlling unit that determines an amount of power supplied based on a detected temperature of the temperature detecting unit, and controls the temperature of the heating unit by supplying the determined amount of power supplied, wherein temperature is sampled by the temperature detecting unit at a prescribed cycle, and the amount of power supplied is determined on the basis of this detection result, when the duty cycle of the determined amount of power supplied is no more than 50%, a first period during which power is intermittently supplied to the heating unit, and a second period during which a power supply to the heating unit is not permitted are set within the prescribed cycle, such that a total amount of power supplied in the first period and second period becomes the amount of power supplied, power being supplied to the heating unit during the first period in a power-supply pattern comprising one unit of energization and one unit of non-energization, and power not being supplied to the heating unit during the subsequent second period, and when the duty cycle of the determined amount of power supplied exceeds 50%, a first period during which power is intermittently supplied to the heating unit, and a third period during which power is continuously supplied to the heating unit are set within the prescribed cycle, such that a total amount of power supplied in the first period and third period becomes the amount of power supplied, power being supplied to the heating unit during the first period in a power-supply pattern comprising one unit of energization and one unit of non-energization, and power being supplied continuously to the heating unit during the subsequent third period.

2. A fixing device, which utilizes the fixing device temperature control method of claim 1.

3. An image-forming apparatus, comprising the fixing device of claim 2.

* * * * *